US010352582B2

(12) United States Patent
Kojima et al.

(10) Patent No.: US 10,352,582 B2
(45) Date of Patent: Jul. 16, 2019

(54) DECORATIVE PANEL AND AIR-CONDITIONER INDOOR UNIT PROVIDED WITH SAME

(71) Applicant: DAIKIN INDUSTRIES, LTD., Osaka-shi, Osaka (JP)

(72) Inventors: Nobuyuki Kojima, Osaka (JP); Yoshiteru Nouchi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 736 days.

(21) Appl. No.: 14/787,921

(22) PCT Filed: Mar. 31, 2014

(86) PCT No.: PCT/JP2014/001888
§ 371 (c)(1),
(2) Date: Oct. 29, 2015

(87) PCT Pub. No.: WO2014/178166
PCT Pub. Date: Nov. 6, 2014

(65) Prior Publication Data

US 2016/0076789 A1 Mar. 17, 2016

(30) Foreign Application Priority Data

Apr. 30, 2013 (JP) ..... 2013-095517
Apr. 30, 2013 (JP) ..... 2013-095519

(51) Int. Cl.
*F24F 13/06* (2006.01)
*F24F 13/20* (2006.01)
(Continued)

(52) U.S. Cl.
CPC ..... *F24F 13/20* (2013.01); *F24F 1/0014* (2013.01); *F24F 1/0047* (2019.02); *F24F 2013/0616* (2013.01); *F24F 2013/205* (2013.01)

(58) Field of Classification Search
CPC .. F24F 13/20; F24F 1/0014; F24F 2013/0616; F24F 2013/205; F24F 1/0047; F14F 2001/0037
(Continued)

(56) References Cited

U.S. PATENT DOCUMENTS 7,771,259 B2 * 8/2010 Pettit ..... F24F 13/084 454/289
2001/0054493 A1 * 12/2001 Hatanaka ..... F24F 1/0011 165/53
(Continued)

FOREIGN PATENT DOCUMENTS

JP 2-96523 U 8/1990
JP 3-129832 A 12/1991
(Continued)

*Primary Examiner* — Gregory L Huson
*Assistant Examiner* — Dana K Tighe
(74) *Attorney, Agent, or Firm* — Birch, Stewart, Kolasch & Birch, LLP

(57) ABSTRACT

Disclosed herein is a decorative panel for a ceiling-mounted indoor unit of an air conditioning device, and the panel is configured to improve the design of a suction grill without increasing the number of manufacturing process steps. The decorative panel includes: a panel body having a suction port; and a suction grill attached to the suction port of the panel body. The suction grill has a grill body which is formed in the shape of a grid to have a large number of suction holes and is positioned over the suction port. A large
(Continued)

number of recesses are formed in a lower surface of the decorative panel so as to be arranged along, and to surround, the grill body.

15 Claims, 9 Drawing Sheets

(51) Int. Cl.
*F24F 1/0014* (2019.01)
*F24F 1/0047* (2019.01)

(58) Field of Classification Search
USPC ..... 454/245, 251, 347, 349, 354
See application file for complete search history.

(56) References Cited

U.S. PATENT DOCUMENTS

2006/0070658 A1* 4/2006 Nakata ..... F24F 1/0007 137/312
2010/0317282 A1* 12/2010 Okada ..... F24F 1/0007 454/292
2012/0063899 A1* 3/2012 Ikeda ..... F04D 25/088 416/146 R

FOREIGN PATENT DOCUMENTS

| | | | |
|---|---|---|---|
| JP | 6-28929 | U | 4/1994 |
| JP | 7-49135 | A | 2/1995 |
| JP | 9-196406 | A | 7/1997 |
| JP | 10-141700 | A | 5/1998 |
| JP | 2000-81238 | A | 3/2000 |
| JP | 2007-317504 | A | 12/2007 |
| JP | 2008-96030 | A | 4/2008 |
| JP | 2009-103240 | A | 5/2009 |
| JP | 2009-168347 | A | 7/2009 |
| JP | 2010-107089 | A | 5/2010 |
| JP | 2010-121934 | A | 6/2010 |

* cited by examiner

DECORATIVE PANEL AND AIR-CONDITIONER INDOOR UNIT PROVIDED WITH SAME

TECHNICAL FIELD

The present invention relates to a decorative panel for a ceiling-mounted indoor unit of an air conditioning device, and an indoor unit for an air conditioning device including the decorative panel.

BACKGROUND ART

Ceiling mounted indoor units mounted on the ceiling of a room have been used as indoor units for air conditioning devices. An indoor unit of this type includes an indoor unit body including an indoor heat exchanger and a blower fan that are housed in a casing having an opened bottom, and a decorative panel attached to the bottom of the indoor unit body. The decorative panel has a suction port in a center portion thereof, in which a suction grill is fitted.

The suction grill of the indoor unit described above is comprised of a square outer frame member and a large number of bars arranged parallel to each other between two opposing sides of the outer frame member. In this configuration, the suction grill is provided with a plurality of rectangular suction holes arranged parallel to each other, each of which has longer sides that are substantially as long as one of the sides of the outer frame member.

CITATION LIST

Patent Document

[Patent Document 1] Japanese Unexamined Patent Publication No. 2010-121934

SUMMARY OF THE INVENTION

Technical Problem

When a human is near the indoor unit, the indoor unit does not come in his/her view unless he/she looks up by moving his/her head considerably upward. However, when the human is rather distant from the indoor unit, he/she can see the indoor unit easily by moving his/head slightly upward. Thus, if a suction grill having such rectangular suction holes is used as in the above-described indoor unit, space behind the rectangular suction holes is visible to the human who is so distant from the indoor unit that the indoor unit comes into his/her view. That is, only the suction port of the decorative panel looks dark, which impairs the beauty of the indoor space.

To cope with this problem, for example, the lower surface of the decorative panel may be colored such that the color of a portion surrounding the dark suction port is gradually lightened outward from the center portion so as to obscure the boundary between the dark suction port and its surrounding portion. This may improve the design of the decorative panel. However, such a technique requires an additional coloring step to improve the design of the panel, which increases the number of manufacturing process steps disadvantageously.

In view of the foregoing, it is therefore an object of the present invention to improve the design of a suction grill of a decorative panel for an indoor unit of an air conditioning device to be mounted on a ceiling without increasing the number of manufacturing process steps.

Solution to the Problem

A first aspect of the invention is a decorative panel for an air conditioning device attached to the bottom of an indoor unit body (21) mounted on a ceiling. The decorative panel includes: a panel body (41) having a suction port (42*a*); and a suction grill (60) having a grill body (61) which is formed in the shape of a grid to have a large number of suction holes (63) and which is positioned over the suction port (42*a*). The suction grill (60) is attached to the suction port (42*a*) of the panel body (41). A large number of recesses (81) are formed in a lower surface of the decorative panel so as to be arranged along, and to surround, the grill body (61).

According to the first aspect of the invention, a large number of recesses (81) are formed in a lower surface of the decorative panel so as to be arranged along, and to surround, the grill body (61) having a large number of suction holes (63). Thus, even if the grill body (61) looks dark to the eyes of a human who stays at a position where he/she can see the indoor unit easily by moving his/her head slightly upward, a shadow cast by those recesses (81) arranged along the grill body (61) obscures the boundary between the dark grill body (61) and a portion surrounding the grill body (61) having no suction holes (63) and thus looking lighter. This allows for improving the design of the decorative panel.

A second aspect of the invention is an embodiment of the first aspect of the invention. In the second aspect, the large number of recesses (81) are formed such that two or more lines of the recesses (81) are formed so as to be arranged along, and to surround, the grill body (61), and that their opening area decreases gradually from the innermost one of the lines toward the outermost one.

According to the second aspect of the invention, the large number of recesses (81) are formed such that two or more lines of the recesses (81) are formed so as to be arranged along, and to surround the grill body (61), and that their opening area decreases gradually from the innermost one of the lines to the outermost one. The recesses (81) having a relatively small opening area cast a fainter shadow than the recesses (81) having a relatively large opening area. That is, to the eyes of a human who stays at a position where he/she can see the indoor unit easily by moving his/her head slightly upward, the color of the lower surface of the decorative panel appears to be gradually being lightened outward from the central grill body (61). This allows for further improving the design of the decorative panel.

A third aspect of the invention is an embodiment of the second aspect of the invention. In the third aspect, the large number of recesses (81) are formed to have an opening area smaller than a transverse cross-sectional area of the large number of suction holes (63).

According to the third aspect of the invention, the large number of recesses (81) are formed to have an opening area smaller than the transverse cross-sectional area of the large number of suction holes (63) in the grill body (61). Further, the recesses (81) arranged to form two or more lines along the grill body (61) have their opening area decreased gradually from the innermost one of the lines toward the outermost one. That is, a large number of openings including the suction holes (63) and the recesses (81) formed in the lower surface of the decorative panel have their opening area decreased gradually outward from the central grill body (61).

A fourth aspect of the invention is an embodiment of any one of the first to third aspects of the invention. In the fourth aspect, the grill body (61) is configured such that each of the suction holes (63) has a square transverse section, and that a surrounding wall forming at least two of the suction holes (63) has a height which is not less than a product of a width of the suction holes (63) and tan 30°.

Speaking of a human field of view, a stable field of fixation in which one can gaze a given object easily by moving his/her head is considered to fall in the range of 20 to 30 degrees upward from the horizontal direction.

According to the fourth aspect of the invention, the decorative panel is configured such that the grill body (61) of the suction grill (60) positioned over the suction port (42*a*) is formed in the shape of a grid to have a large number of suction holes (63) each having a square transverse section, and that a surrounding wall forming the suction holes (63) has a height which is not less than the product of the width of the suction holes (63) and tan 30°. Thus, as illustrated in FIG. 8, the surrounding wall forming the suction holes (63) hides the space behind the suction holes (63) from the eyes of a human who stays at a position where he/she can see the indoor unit easily by moving his/her head slightly upward. Thus, the suction holes (63) no longer look dark.

A fifth aspect of the invention is an embodiment of the fourth aspect of the invention. In the fifth aspect, the grill body (61) is configured such that outer ones (63*a*) of the suction holes (63) arranged in an outer peripheral portion of the grill body (61) have a narrower width than the other inner suction holes (63*b*) arranged inside the outer suction holes (63*a*).

According to the fifth aspect of the invention, the grid-shaped grill body (61) is configured such that the outer suction holes (63*a*) arranged in the outer peripheral portion of the grill body (61) have a narrower width than the other inner suction holes (63*b*) arranged inside them. That is, the grill body (61) is configured such that the surrounding wall forming the outer suction holes (63*a*) of the grill body (61) is thicker than the one forming the inner suction holes (63*b*). Thus, the outer peripheral portion of the lower surface of the grill body (61) has a lower opening area ratio per unit area than the inner portion. Consequently, to the eyes of a human who stays at a position where he/she can see the indoor unit easily by moving his/her head slightly upward, the outer peripheral portion of the lower surface of the grill body (61) looks lighter in color than the inner portion, because the openings form a fainter shadow there. On the other hand, comparing the lower surface of the grill body (61) with a portion surrounding the grill body (61), the latter portion looks slightly dark due to the shadow cast by the recesses (81) but still looks lighter in color than the lower surface of the grill body (61) having the large number of suction holes (63). In addition, comparing the portion having the large number of recesses (81) with its surrounding portion, the latter portion looks lighter in color than the portion with the recesses (81), because it has no openings and thus casts no shadow. Thus, to the eyes of a human who stays at a position where he/she can see the indoor unit easily by moving his/her head slightly upward, the color of the lower surface of the decorative panel appears to be gradually being lightened from the center portion toward the outer periphery.

A sixth aspect of the invention is an embodiment of the fifth aspect of the invention. In the sixth aspect, the grill body (61) is configured such that the inner suction holes (63*b*) have a width of 11 mm to 15 mm.

In the above-described configuration, the surrounding wall forming the suction holes (63) has its height determined relative to the width of the suction holes (63). Thus, if the width of the suction holes (63) is made too broad, the surrounding wall forming the suction holes (63) turns taller, which increases the thickness of the suction grill (60) and eventually increases the overall size of the indoor unit.

According to the sixth aspect of the invention, the grill body (61) is configured such that among the suction holes (63) of the grill body (61), the inner ones (63*b*) having a relatively broad width have a width of 11 mm to 15 mm. Thus, even if the surrounding wall forming the suction holes (63) has its height determined by multiplying the width of the suction holes (63) by tan 30°, the surrounding wall does not become so high as to increase the overall size of the indoor unit.

A seventh aspect of the invention is an embodiment of any one of the first to sixth aspects of the invention. In the seventh aspect, the suction grill (60) has an extension (65) extending outward from an entire periphery of the grill body (61) to overlap with a lower surface of the panel body (41), and the recesses (81) are formed in the extension (65).

According to the seventh aspect of the invention, the suction grill (60) has an extension (65) extending outward from an entire periphery of the grill body (61), which is positioned over the suction port (42*a*), so as to overlap with the lower surface of the panel body (41). Thus, unlike the configuration in which the suction grill (60) is fitted in the suction port (42*a*), no seam is left between them (60, 42*a*).

An eighth aspect of the invention is an embodiment of the seventh aspect of the invention. In the eighth aspect, the suction grill (60) is made of an injection-molded resin.

According to the eighth aspect of the invention, the suction grill (60) including the grill body (61) having the large number of suction holes (63) and the extension (65) having the large number of recesses (81) is made of an injection-molded resin.

A ninth aspect of the invention is an indoor unit for an air conditioning device. The indoor unit includes: an indoor unit body (21) mounted on a ceiling; and a decorative panel (40) attached to a bottom of the indoor unit body (21). The decorative panel (40) is configured as the decorative panel of any one of the first to eighth aspects of the invention.

According to the ninth aspect of the invention, in the indoor unit for an air conditioning device including the indoor unit body (21) and the decorative panel (40), the decorative panel (40) is configured as the decorative panel of any one of the first to eighth aspects of the invention which allows for improving the design of the suction grill without increasing the number of manufacturing process steps.

Advantages of the Invention

According to the first aspect of the invention, a large number of recesses (81) are formed in a lower surface of the decorative panel so as to be arranged along, and to surround, the grill body (61) having a large number of suction holes (63). Thus, even if the grill body (61) looks dark to the eyes of a human who stays at a position where he/she can see the indoor unit easily by moving his/her head slightly upward, a shadow cast by those recesses (81) arranged along the grill body (61) obscures the boundary between the dark grill body (61) and a portion surrounding the grill body (61) having no suction holes (63) and thus looking lighter. Therefore, in manufacturing the decorative panel, the design of the decorative panel is easily improved by merely forming the large number of recesses (81), as well as the large number of suction holes (63), without increasing the number of manufacturing process steps by an additional coloring step, for example.

According to the second aspect of the invention, the large number of recesses (81) are formed such that two or more lines of the recesses (81) are formed so as to be arranged along, and to surround, the grill body (61), and that their opening area decreases gradually from the innermost one of the lines toward the outermost one. Thus, to the eyes of a human who stays at a position where he/she can see the indoor unit easily by moving his/her head slightly upward, the color of the lower surface of the decorative panel appears to be gradually being lightened outward from the central grill body (61). This simple configuration allows for further improving the design of the decorative panel.

According to the third aspect of the invention, the large number of recesses (81) are formed to have an opening area smaller than the transverse cross-sectional area of the suction holes (63) in the grill body (61). Thus, a large number of openings including the suction holes (63) and the recesses (81) formed in the lower surface of the decorative panel are allowed to have their opening area decreased gradually outward from the central grill body (61). Such a gradually changing opening area of the openings makes each of the openings inconspicuous. This simple configuration allows for further improving the design of the decorative panel.

As for a solution to the problem of the impaired beauty of the indoor space due to the dark look of the suction port of the decorative panel only, for example, thick bar members could be used to reduce the width of the suction holes. This could reduce the ratio of the sum of the opening areas of the suction holes to the entire lower surface of the suction grill to prevent the suction holes from looking dark. However, reducing the width of the suction holes should increase the resistance to the air passing through them, which would deteriorate the performance of the air conditioning device disadvantageously.

Thus, according to the fourth aspect of the invention, the decorative panel is configured such that the grill body (61) of the suction grill (60) is formed in the shape of a grid to have a large number of suction holes (63) each having a square transverse section, and that the surrounding wall forming at least two of the suction holes (63) has a height which is not less than the product of the width of the suction holes (63) and tan 30°. That is, as illustrated in FIG. 8, the grill body (61) is configured such that the height of the surrounding wall is large enough relative to the width of the suction holes (63) to hide the space behind the suction holes (63) from the eyes of a human who stays at a position where he/she can see the indoor unit easily by moving his/her head slightly upward. As a result, the suction holes (63) no longer look dark to the eyes of the human who stays at the position where he/she can see the indoor unit easily by moving his/her head slightly upward. Thus, by determining the height of the surrounding wall forming the suction holes (63) relative to the width of the suction holes (63) such that the suction holes (63) do not look dark to the eyes of a human who stays at a position where he/she can see the indoor unit easily by moving his/her head slightly upward, the design of the decorative panel is easily improved without increasing the resistance to the air passing through the suction holes as in a situation where the width of the suction holes (63) is reduced.

According to the fifth aspect of the invention, the grid-shaped grill body (61) is configured such that the outer suction holes (63*a*) arranged in the outer peripheral portion of the grill body (61) have a narrower width than the inner suction holes (63*b*) arranged inside them. That is, the grill body (61) is configured such that the surrounding wall forming the outer suction holes (63*a*) of the grill body (61) is thicker than the one forming the inner suction holes (63*b*). Thus, to the eyes of a human who stays at a position where he/she can see the indoor unit easily by moving his/her head slightly upward, the color of the lower surface of the decorative panel appears to be gradually being lightened from the center portion toward the outer periphery. This simple configuration allows for further improving the design of the decorative panel.

According to the sixth aspect of the invention, the grill body (61) is configured such that among the suction holes (63) of the grill body (61), the inner ones (63*b*) having a relatively broad width has a width of 11 mm to 15 mm. Thus, even if the surrounding wall forming the suction holes (63) has its height determined by multiplying the width of the suction holes (63) by tan 30°, the indoor unit is prevented from increasing its overall size excessively.

According to the seventh aspect of the invention, the suction grill (60) is provided with an extension (65) extending outward from the entire periphery of the grill body (61), which is positioned over the suction port (42*a*), so as to overlap with the lower surface of the panel body (41). Thus, the suction grill (60) with improved design is easily provided without leaving any seams.

According to the eighth aspect of the invention, the suction grill (60) including the grill body (61) having the large number of suction holes (63) and the extension (65) having the large number of recesses (81) is made of an injection-molded resin. Thus, those recesses (81) are easily provided while the suction grill (60) is being formed.

According to the ninth aspect of the invention, an indoor unit for an air conditioning device is provided with a decorative panel (40) which allows for improving the design of the suction grill without increasing the number of manufacturing process steps.

DESCRIPTION OF EMBODIMENTS

An embodiment of the present invention will be described in detail with reference to the drawings. The following description of embodiments is merely an illustrative one in nature, and does not intend to limit the scope of the present invention or applications or uses thereof.

(Air Conditioning Device)

Figure 1:
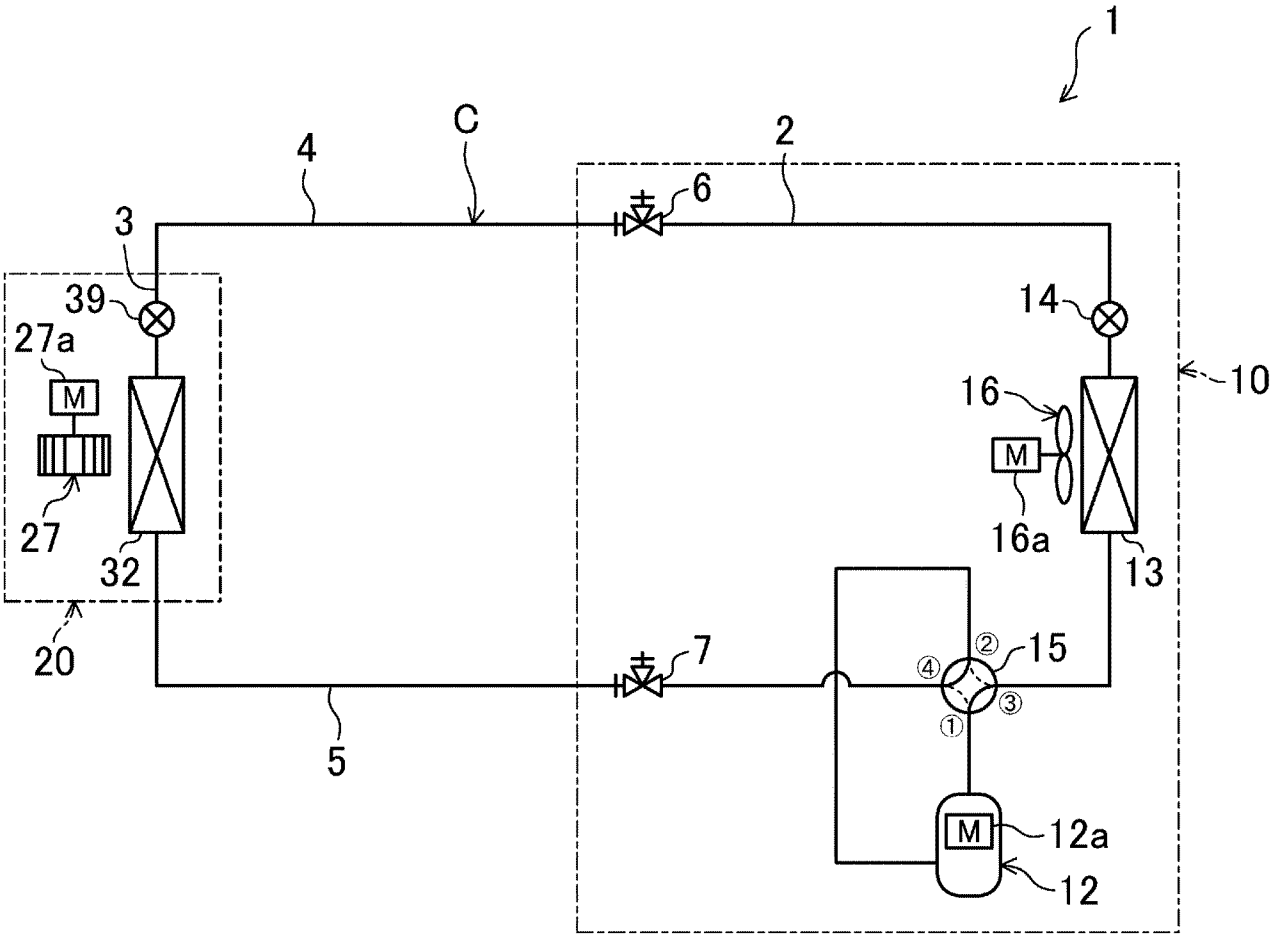
FIG. 1 is a general piping diagram illustrating a configuration for a refrigerant circuit for an air conditioning device according to an embodiment.

An embodiment of the present invention is an air conditioning device (1) configured to cool and heat indoor air. As illustrated in FIG. 1, the air conditioning device (1) includes an outdoor unit (10) installed outdoors, and an indoor unit (20) installed indoors. The outdoor unit (10) has an outdoor circuit (2) through which a refrigerant flows, and the indoor unit (20) has an indoor circuit (3) through which the refrigerant flows. The outdoor and indoor circuits (2) and (3) are connected with each other through a liquid communication pipe (4) and a gas communication pipe (5), which thus forms a refrigerant circuit (C). In the refrigerant circuit (C), a refrigerant injected therein is circulated to perform a vapor compression refrigeration cycle.

In the outdoor circuit (2) of the outdoor unit (10), connected together are a liquid-side shut-off valve (6), a gas-side shut-off valve (7), a compressor (12), an outdoor heat exchanger (13), an outdoor expansion valve (14), and a four-way switching valve (15). The liquid communication pipe (4) is connected to the liquid-side shut-off valve (6), and the gas communication pipe (5) is connected to the gas-side shut-off valve (7).

The compressor (12) compresses a low-pressure refrigerant, and discharges a high-pressure refrigerant thus compressed. In the compressor (12), a compression mechanism such as a scroll or rotary compression mechanism is driven by a compressor motor (12*a*). The compressor motor (12*a*) is configured so that the number of rotation (i.e., the operation frequency) thereof can be changed by an inverter.

The outdoor heat exchanger (13) is a fin and tube heat exchanger. An outdoor fan (16) is installed near the outdoor heat exchanger (13). In the outdoor heat exchanger (13), the air transported by the outdoor fan (16) exchanges heat with a refrigerant. The outdoor fan (16) is configured as a propeller fan driven by an outdoor fan motor (16*a*). The outdoor fan motor (16*a*) is configured so that the number of rotation thereof can be changed by an inverter.

The outdoor expansion valve (14) is configured as an electronic expansion valve, of which the degree of opening is variable. The outdoor expansion valve (14) is connected to a liquid-side end portion of the outdoor heat exchanger (13) and the liquid-side shut-off valve (6).

The four-way switching valve (15) includes first to fourth ports. In the four-way switching valve (15), the first port is connected to a discharge side of the compressor (12), the second port is connected to a suction side of the compressor (12), the third port is connected to a gas-side end portion of the outdoor heat exchanger (13), and the fourth port is connected to the gas-side shut-off valve (7). The four-way switching valve (15) is switchable between a first state (a state indicated by the solid curves in FIG. 1) and a second state (a state indicated by the broken curves in FIG. 1). In the four-way switching valve (15) in the first state, the first port communicates with the third port, and the second port communicates with the fourth port. In the four-way switching valve (15) in the second state, the first port communicates with the fourth port, and the second port communicates with the third port.

An indoor heat exchanger (32) and an indoor expansion valve (39) are connected together in the indoor circuit (3) of the indoor unit (20).

The indoor heat exchanger (32) is a fin and tube heat exchanger. The gas communication pipe (5) is connected to a gas-side end-portion of the indoor heat exchanger (32). The indoor expansion valve (39) is connected to a liquid-side end portion of the indoor heat exchanger (32). An indoor fan (27) is installed near the indoor heat exchanger (32). The indoor fan (27) is a centrifugal blower driven by an indoor fan motor (27*a*). The indoor fan motor (27*a*) is configured so that the number of rotation thereof can be changed by an inverter.

The indoor expansion valve (39) is configured as an electronic expansion valve, of which the degree of opening is variable. The indoor expansion valve (39) is connected to the liquid-side end portion of the indoor heat exchanger (32) and the liquid communication pipe (4).

<Operation Mechanism of Air Conditioning Device>

The air conditioning device (1) makes a switch between a cooling operation and a heating operation in the following manner.

During the cooling operation, the four-way switching valve (15) is switched to the first state (the state indicated by the solid curves in FIG. 1) to make the compressor (12), the indoor fan (27), and the outdoor fan (16) operate. Thus, the refrigerant circuit (C) performs a refrigeration cycle in which the outdoor heat exchanger (13) serves as a condenser, and the indoor heat exchanger (32) serves as an evaporator. Specifically, a high-pressure refrigerant compressed by the compressor (12) flows through the outdoor heat exchanger (13) and dissipates heat to outdoor air to condense. The condensed refrigerant has its pressure reduced by the indoor expansion valve (39) of the indoor unit (20), flows through the indoor heat exchanger (32), and absorbs heat from indoor air to evaporate. As a result, the indoor air is cooled by the refrigerant, and the air thus cooled is supplied to an indoor space (R). On the other hand, the refrigerant evaporated in the indoor heat exchanger (32) is sucked into the compressor (12) and is compressed again.

During the heating operation, the four-way switching valve (15) is switched to the second state (the state indicated by the broken curves in FIG. 1) to make the compressor (12), the indoor fan (27), and the outdoor fan (16) operate. Thus, the refrigerant circuit (C) performs a refrigeration cycle in which the indoor heat exchanger (32) serves as a condenser, and the outdoor heat exchanger (13) serves as an evaporator. Specifically, a high-pressure refrigerant compressed by the compressor (12) flows through the indoor heat exchanger (32) of the indoor unit (20) and dissipates heat to the indoor air to condense. As a result, the indoor air is heated by the refrigerant, and the air thus heated is supplied to the indoor space (R). On the other hand, the refrigerant condensed in the indoor heat exchanger (32) has its pressure reduced by the outdoor expansion valve (14) of the outdoor unit (10), and then flows through the outdoor heat exchanger (13). In the outdoor heat exchanger (13), the refrigerant absorbs heat from the outdoor air to evaporate. The refrigerant thus evaporated is sucked into the compressor (12) and is compressed again.

(Detailed Structure of Indoor Unit)

Next, a detailed structure of the indoor unit (20) of the air conditioning device (1) will be described with reference to FIGS. 2-4. The indoor unit (20) of this embodiment is configured as a ceiling mounted indoor unit, and includes an indoor unit body (21) which is fitted and attached into an opening (O) of a ceiling (U) facing the indoor space (R), and a decorative panel (40) attached to the bottom of the indoor unit body (21). In this embodiment, the indoor unit body (21) is suspended by a suspending mechanism (not shown) in a space above the ceiling (U) (i.e., a roof space). The decorative panel (40) attached to the bottom of the indoor unit body (21) closes the opening (O) of the ceiling (U) and a lower surface of the indoor unit body (21).

<Indoor Unit Body>

Figure 2:
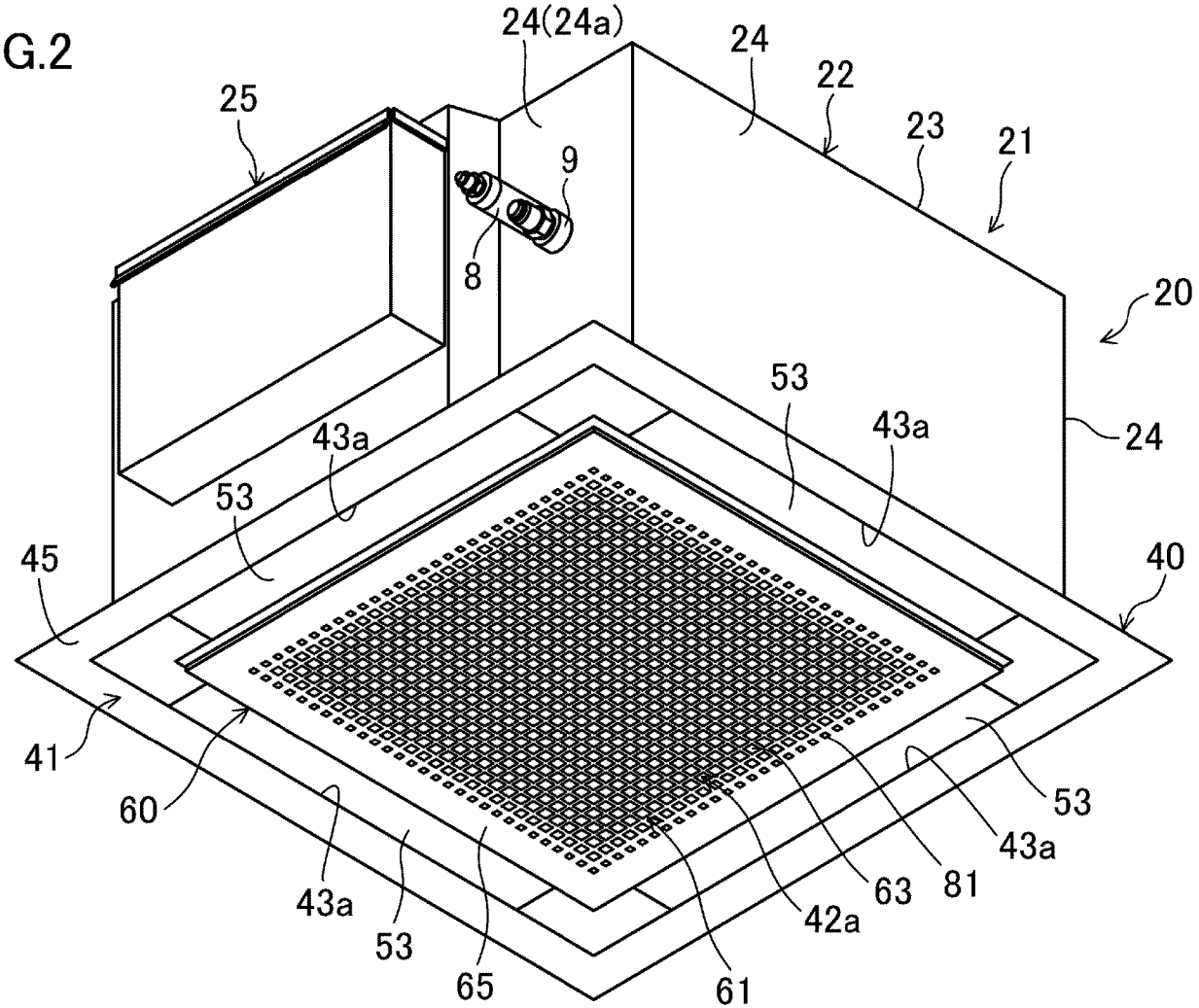
FIG. 2 is a perspective view showing the appearance of an indoor unit according to an embodiment.
Figure 3:
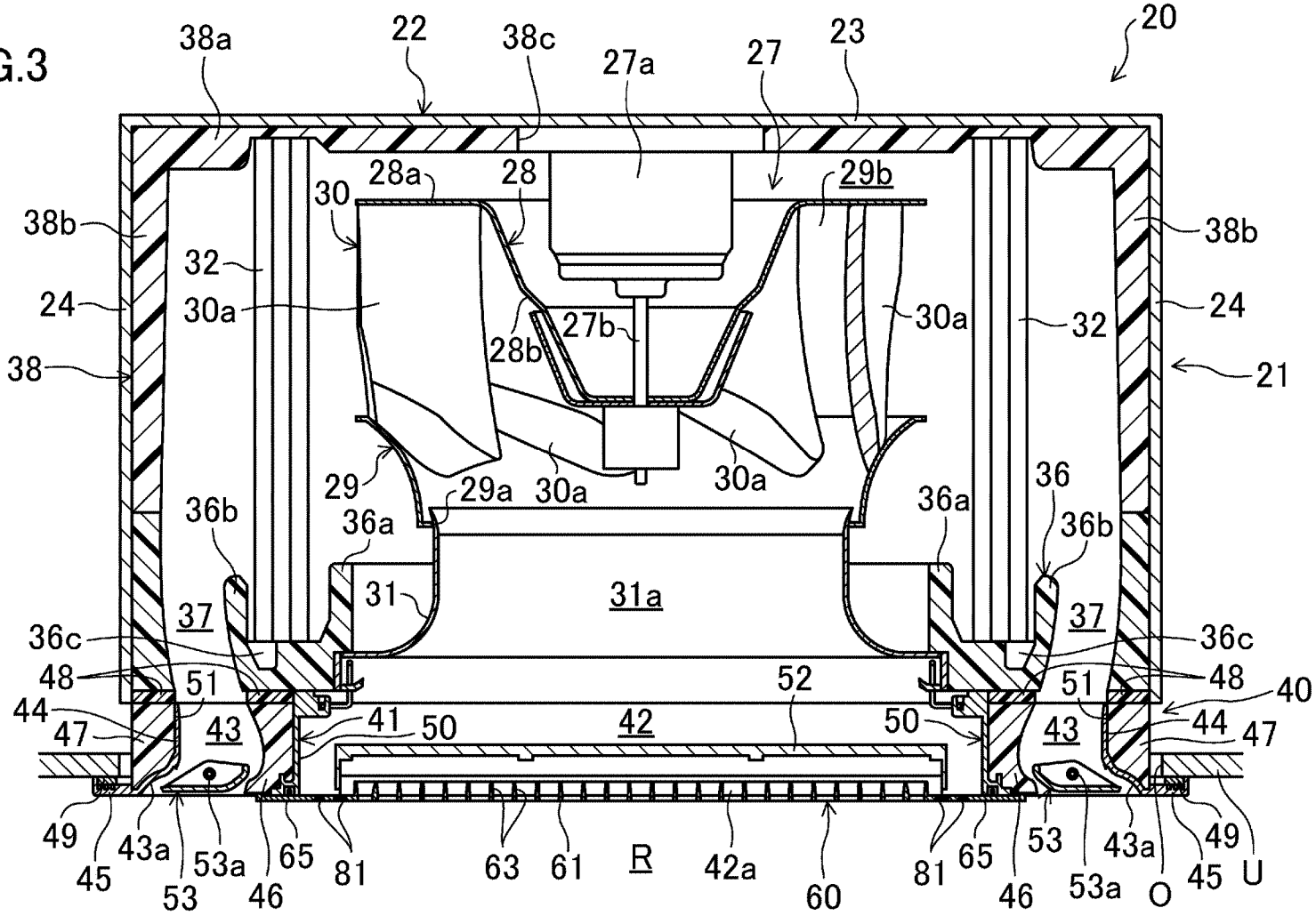
FIG. 3 is a vertical cross-sectional view showing an internal structure of an indoor unit according to an embodiment.

As illustrated in FIGS. 2 and 3, the indoor unit body (21) includes a casing (22). The casing (22) includes a top panel (23) which is generally square in a plan view and four generally rectangular side panels (24) extending downward from a peripheral portion of the top panel (23), and is configured as a box-shaped casing having a generally rectangular parallelepiped shape and an opening in its lower surface. As illustrated in FIG. 2, an elongate, box-shaped electric component box (25) is attached to a side panel (24*a*), which is one of the four side panels (24). Also, a liquid-side connecting pipe (8) and a gas-side connecting pipe (9), which are connected to the indoor heat exchanger (32), run through this side panel (24*a*). The liquid-side connecting pipe (8) is connected to the liquid communication pipe (4), and the gas-side connecting pipe (9) is connected to the gas communication pipe (5).

The casing (22) houses the indoor fan (27), a bell mouth (31), the indoor heat exchanger (32), and a drain pan (36).

Figure 4:
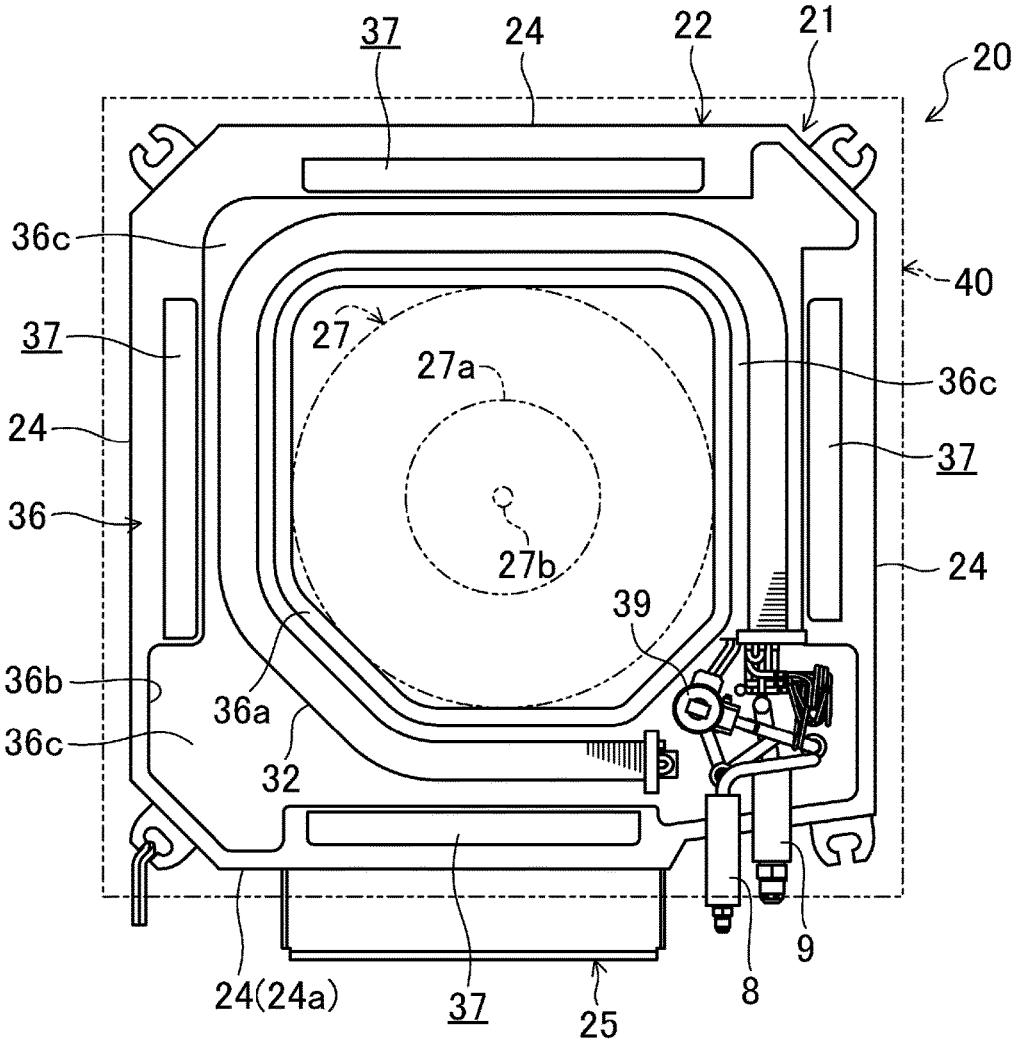
FIG. 4 is a view showing the inside of an indoor unit according to an embodiment as viewed from over a top plate.

As illustrated in FIGS. 3 and 4, the indoor fan (27) is arranged at the center inside the casing (22). The indoor fan (27) includes the indoor fan motor (27*a*), a hub (28), a shroud (29), and an impeller (30). The indoor fan motor (27*a*) is supported on the top panel (23) of the casing (22). The hub (28) is fixed to a lower end of a drive shaft (27*b*) of the indoor fan motor (27*a*) to be driven in rotation. The hub (28) includes a ringlike base (28*a*) provided radially outside of the indoor fan motor (27*a*), and a central swelling portion (28*b*) expanding downward from an inner peripheral portion of the base (28*a*).

The shroud (29) is arranged under the base (28*a*) of the hub (28) so as to face the base (28*a*). A lower portion of the shroud (29) is provided with a circular central suction port (29*a*) communicating with the inside of the bell mouth (31). The impeller (30) is housed in an impeller housing space (29*b*) between the hub (28) and the shroud (29). The impeller (30) is comprised of a plurality of turbo blades (30*a*) arranged along the rotation direction of the drive shaft (27*b*).

The bell mouth (31) is arranged under the indoor fan (27). The bell mouth (31) has a circular opening at each of its upper and lower ends, and is formed in a tubular shape so that the area of the opening increases toward the decorative panel (40). The inner space (31*a*) of the bell mouth (31) communicates with the impeller housing space (29*b*) of the indoor fan (27).

As illustrated in FIG. 4, the indoor heat exchanger (32) is provided so as to surround the indoor fan (27) by bending a refrigerant pipe (a heat transfer tube). The indoor heat exchanger (32) is installed on the upper surface of the drain pan (36) so as to stand up vertically. Air blowing laterally from the indoor fan (27) passes through the indoor heat exchanger (32). The indoor heat exchanger (32) serves as an evaporator that cools the air during a cooling operation, and also serves as a condenser (a radiator) that heats the air during a heating operation.

As illustrated in FIGS. 3 and 4, the drain pan (36) is arranged under the indoor heat exchanger (32). The drain pan (36) includes an inner wall portion (36*a*), an outer wall portion (36*b*), and a water receiving portion (36*c*). The inner wall portion (36*a*) is formed along an inner peripheral portion of the indoor heat exchanger (32), and is configured as a ringlike vertical wall that stands up vertically. The outer wall portion (36*b*) is formed along the four side panels (24) of the casing (22), and is also configured as a ringlike vertical wall that stands up vertically. The water receiving portion (36*c*) is configured as a coupling member which couples the inner and outer wall portions (36*a*) and (36*b*), and has a groove provided to collect condensed water produced in the indoor heat exchanger (32). In addition, four body-side blowout flow channels (37) extending along the four associated side panels (24) are provided to run vertically through the outer wall portion (36*b*) of the drain pan (36). Each of the body-side blowout flow channels (37) allows a downstream space of the indoor heat exchanger (32) to communicate with an associated one of four panel-side blowout flow channels (43) of the decorative panel (40) which will be described later.

Also, a body-side heat insulator (38) is further provided for the indoor unit body (21). The body-side heat insulator (38) is generally in the shape of a box with an opened bottom. The body-side heat insulator (38) includes a top panel-side heat insulating portion (38*a*) formed along the top panel (23) of the casing (22) and a side panel-side heat insulating portion (38*b*) formed along the side panels (24) of the casing (22). A central portion of the top panel-side heat insulating portion (38*a*) has a circular through hole (38*c*) that an upper end portion of the indoor fan motor (27*a*) penetrates. The side panel-side heat insulating portion (38*b*) is arranged outside the body-side blowout flow channels (37).

<Decorative Panel>

The decorative panel (40) is attached to the lower surface of the casing (22). The decorative panel (40) includes a panel body (41) and a suction grill (60).

<<Panel Body>>

As illustrated in FIGS. 2, 3, 5 and 6, the panel body (41) is configured to have a generally cubic shape which is thin in the vertical direction, and is attached to the bottom of the casing (22). The panel body (41) includes a panel-side suction channel (42), four panel-side blowout flow channels (43), and four panel-side recessed portions (44). A panel extension (45) which is generally in the shape of a frame and extends outward along the ceiling (U) is provided at a lower end of an outer peripheral portion of the panel body (41).

The panel-side suction channel (42) is formed in a center portion of the panel body (41) to penetrate the center portion of the panel body (41) vertically so as to communicate with the inner space (31*a*) of the bell mouth (31) of the indoor unit body (21). The panel-side suction channel (42) is formed inside a rectangular frame-shaped inner panel member (50) of the panel body (41). A rectangular suction port (42*a*) facing the indoor space (R) is formed at a lower end of the panel-side suction channel (42). That is, the panel-side suction channel (42) allows the suction port (42*a*) of the panel body (41) to communicate with the inner space (31*a*) of the bell mouth (31) of the indoor unit body (21). Also, in the panel-side suction flow channel (42), provided is a dust collection filter (52) that catches dust in the air sucked through the suction port (42*a*).

The four panel-side blowout flow channels (43) are formed in the panel body (41) outside the panel-side suction channel (42) to surround the periphery of the panel-side suction channel (42). Specifically, each of the four panel-side blowout flow channels (43) extends along an associated one of four side portions of the panel body (41) to surround the periphery of the panel-side suction channel (42), and penetrates the associated one of the four side portions of the panel body (41) vertically to communicate with an associated one of the four body-side blowout flow channels (37) of the indoor unit body (21). Outlet ports (43*a*) facing the indoor space (R) are formed at lower ends of the four panel-side blowout flow channels (43), respectively. That is to say, the four panel-side blowout flow channels (43) allow the four outlet ports (43*a*) of the panel body (41) to respectively communicate with the four body-side blowout flow channels (37) of the indoor unit body (21).

Each of the panel-side blowout flow channels (43) is provided with an air blowing direction adjusting blade (53) to adjust the direction of the air blown out downward from above. The air blowing direction adjusting blade (53) is configured as a generally rectangular plate body extending from one end to the other of the panel-side blowout flow channel (43) in the longitudinal direction, and is arranged at the lower end of the panel-side blowout flow channel (43). The air blowing direction adjusting blade (53) includes, at each of the two ends in its longitudinal direction, a rotating shaft (53*a*) which is supported rotatably by the panel body (41). Thus, the air blowing direction adjusting blade (53) is allowed to rotate around the rotating shaft (53*a*) that serves as a shaft center.

Each of the four panel-side recessed portions (44) is formed on an associated one of the four outer side surfaces of an outer panel member (51) having a generally rectangular frame shape and defining the outer side surfaces of the four panel-side blowout flow channels (43) of the panel body (41), and is recessed from the associated one of the four outer side surfaces of the outer panel member (51) toward the associated one of the panel-side blowout flow channels (43). The length of each of the panel-side recessed portions (44) in the longitudinal direction is substantially the same as that of the panel-side blowout flow channels (43) in the longitudinal direction.

Inside the four panel-side blowout flow channels (43) (i.e., closer to the center of the panel body (41)), provided respectively are four inner heat insulating members (46). The four panel-side recessed portions (44) are provided with four outer heat insulating members (47), respectively. Further, four inner sealing members (48) are interposed between the respective upper surfaces of the four inner heat insulating members (46) and the lower surface of the drain pan (36) of the indoor unit body (21). Likewise, four inner sealing members (48) are interposed between the respective upper surfaces of the four outer heat insulating members (47) and the lower surface of the drain pan (36) of the indoor unit body (21). On the other hand, an outer sealing member (49) is interposed between an upper surface of the panel extension (45) extending outward from the lower end of the outer peripheral portion of the outer panel member (51) of the panel body (41) and the ceiling (U).

Figure 5:
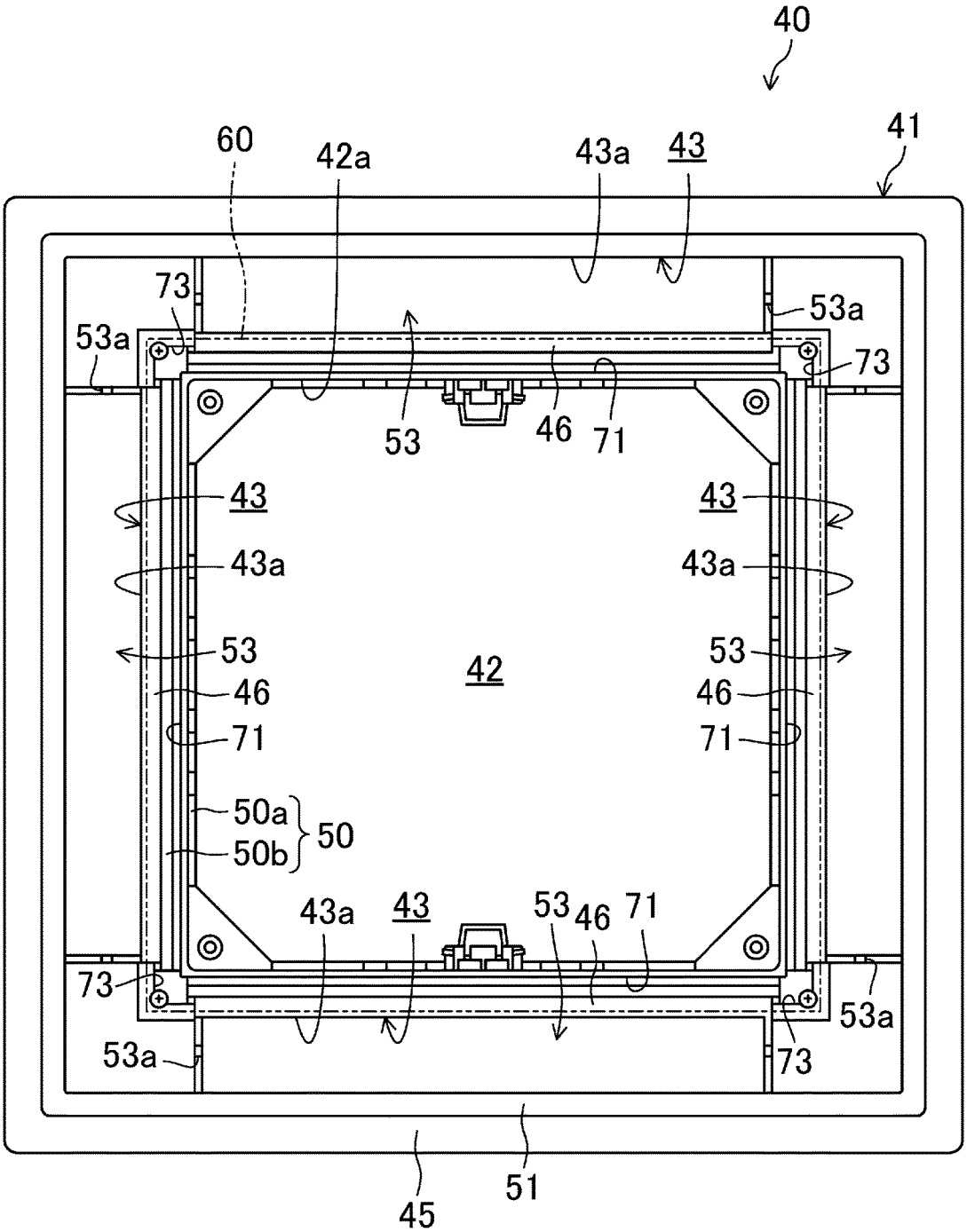
FIG. 5 is a view showing a panel body of a decorative panel according to an embodiment as viewed from an indoor space.

According to this configuration, as illustrated in FIG. 5, a generally square suction port (42*a*) is formed through the center portion of the lower surface of the panel body (41), and four outlet ports (43*a*) are formed around the suction port (42*a*) so as to respectively extend along the four sides of the suction port (42*a*). In addition, the four inner heat insulating members (46) are provided between the suction port (42*a*) of the panel body (41) and the four outlet ports (43*a*), and each of the four inner heat insulating members (46) forms part (inner peripheral portion) of an associated one of the outlet ports (43*a*).

<<Suction Grill>>

The suction grill (60) is attached to the lower end of the panel-side suction channel (42) (i.e., the suction port (42*a*)). The suction grill (60) includes a grid-shaped grill body (61) positioned over the suction port (42*a*), and an extension (65) which extends outward from the entire periphery of the lower end of the grill body (61) toward the four outlet ports (43*a*). The suction grill (60) is made of an injection-molded resin, and thus the grill body (61) and the extension (65) are integrated with each other. The color of the suction grill (60) has lightness that is high enough for a human observer to visually sense a shadow of recesses (81) which will be described later. In this embodiment, the suction grill (60) is made of an off-white resin.

Figure 6:
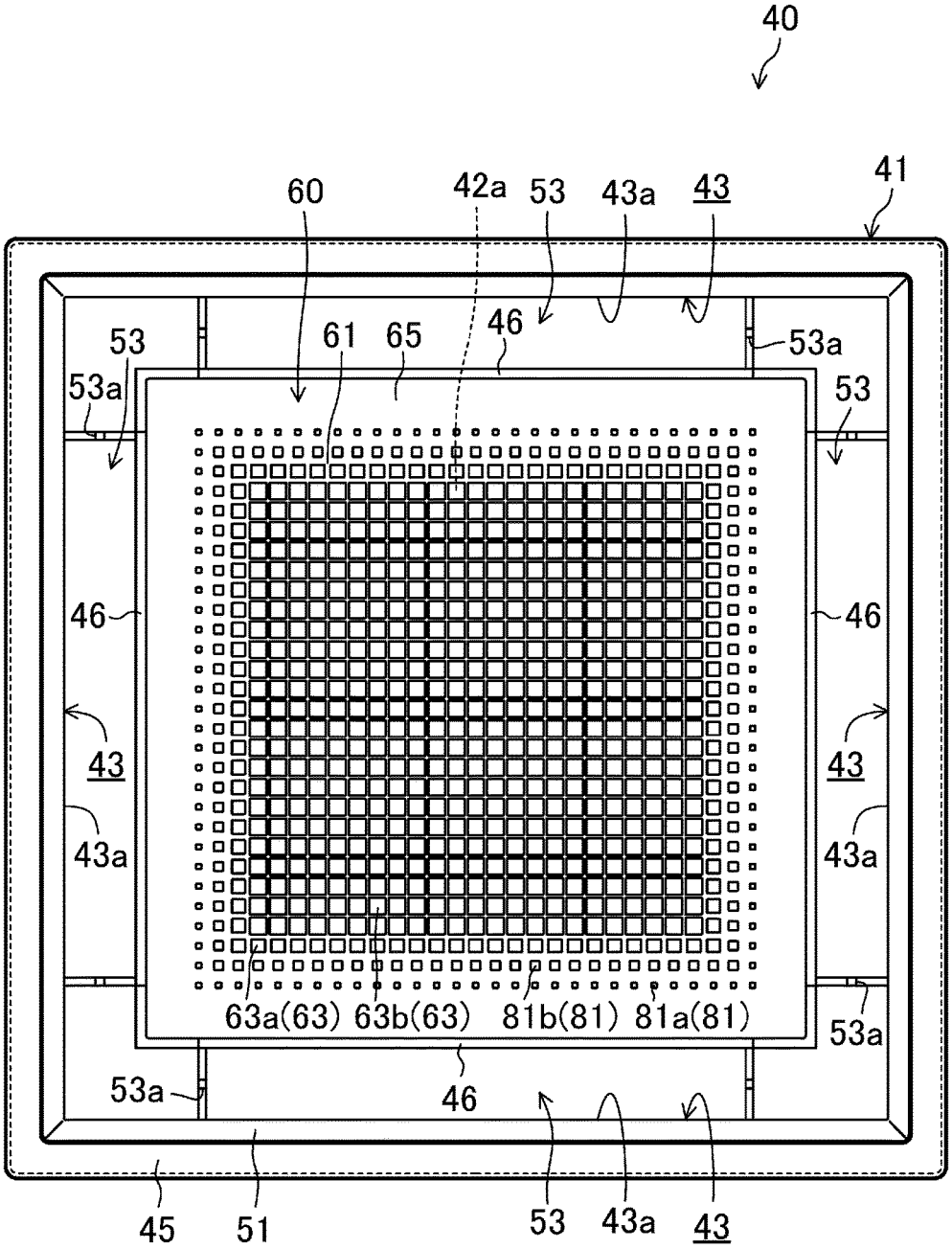
FIG. 6 is a view showing a decorative panel according to an embodiment as viewed from the indoor space.

As illustrated in FIG. 6, the grill body (61) has a generally square shape when viewed in plan. The grill body (61) is a grid-shaped one, and thus has a large number of suction holes (63). In this embodiment, 25 suction ports (63) are arranged both vertically and horizontally to form a 25×25 matrix. Each of the suction holes (63) is configured as a through hole that penetrates through the grill body (61) in its thickness direction (vertical direction). Each of the suction holes (63) is cut to have a square cross section (transverse section).

Figure 7:
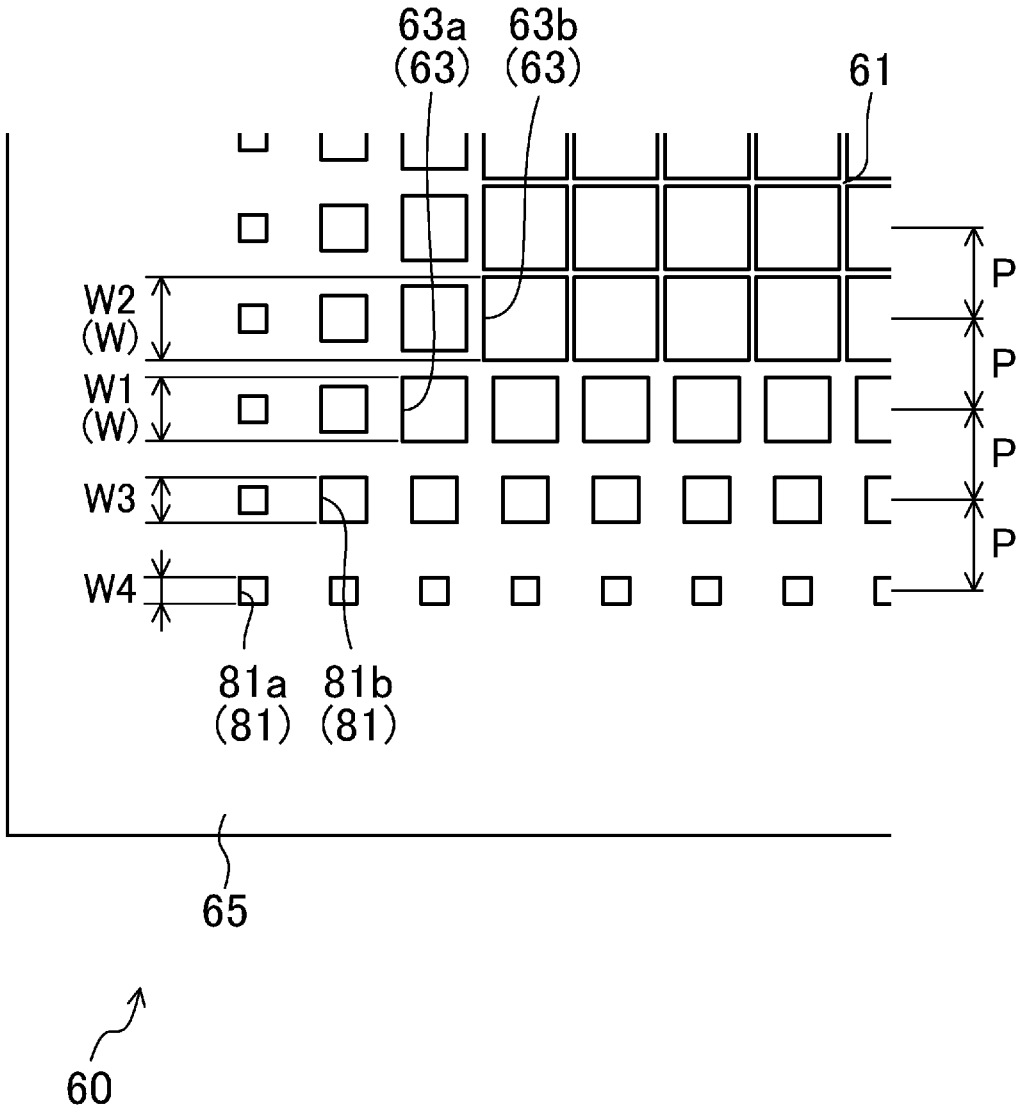
FIG. 7 is a partially enlarged view of FIG. 6.

As shown in FIG. 7, outer ones (63*a*) of the large number of suction holes (63) arranged in an outer peripheral portion of the grill body (61) have a narrower width than the other inner suction holes (63*b*) arranged inside them. In this embodiment, the grill body (61) is configured such that outermost ones (63*a*) of the suction holes (63) have a width W1 narrower than a width W2 of the other suction holes (63*b*) arranged inside them. That is to say, the grill body (61) is configured such that a surrounding wall forming the outermost suction holes (63*a*) is thicker than the one forming the other suction holes (63*b*) arranged inside them. In this embodiment, the grill body (61) is configured such that the outermost suction holes (63*a*) have a width W1 of 8.5 mm and the other suction holes (63*b*) arranged inside them have a width W2 of 11 mm. The inner suction holes (63*b*) are configured to have a width W2 of 11 mm to 15 mm.

Figure 8:
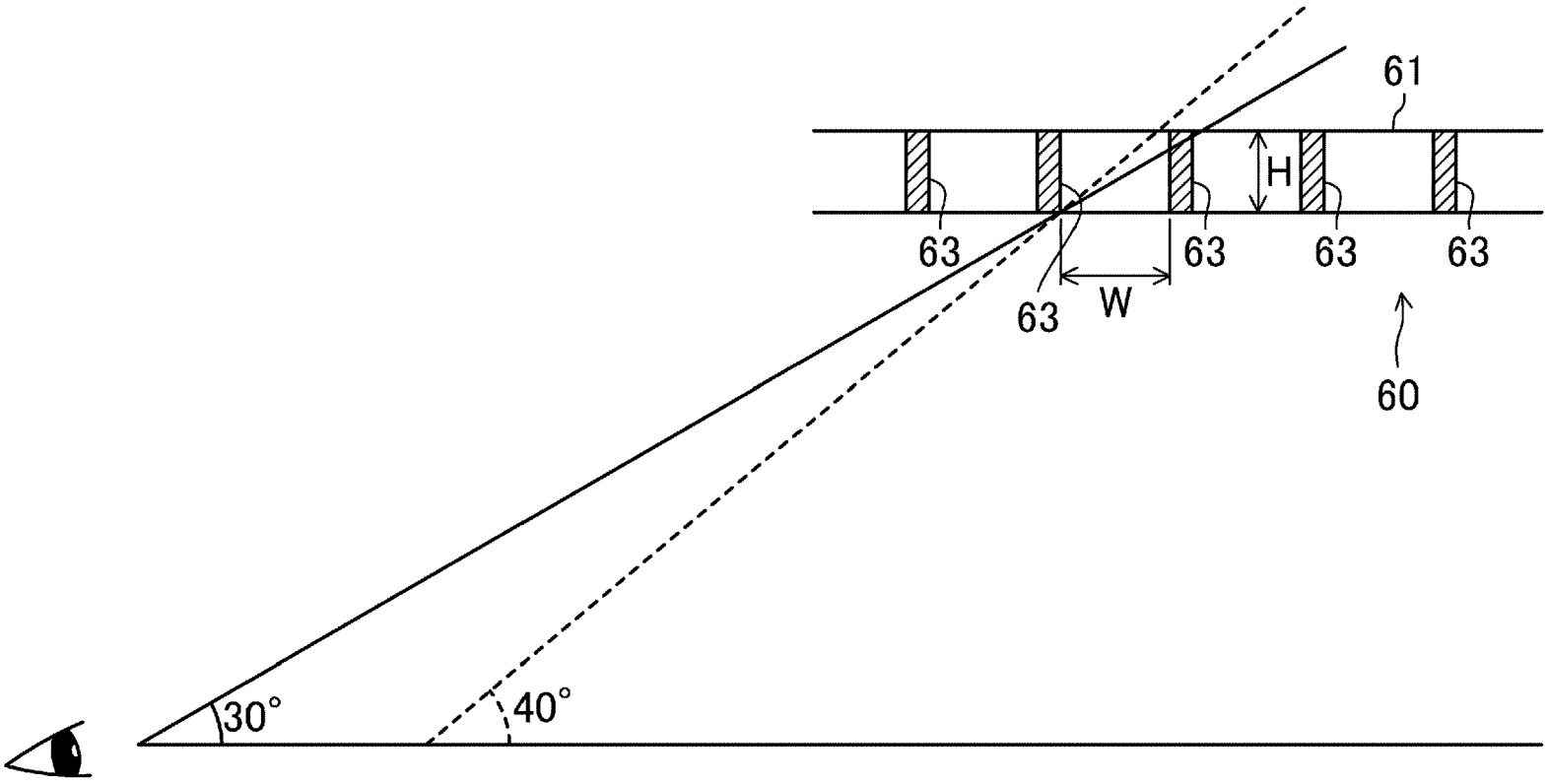
FIG. 8 is a schematic view illustrating how the suction grill of the indoor unit being mounted looks to human eyes.

As illustrated in FIG. 8, the grill body (61) is also configured such that the height H of the surrounding wall forming the suction holes (63) is not less than the product of the width W of the suction holes (63) and tan 30°. In this embodiment, the grill body (61) is configured such that the height H of the surrounding wall of the suction holes (63) is not less than the product of the width W of the suction holes (63) and tan 30°, and is not more than the product of the width W and tan 40°.

Figure 9:
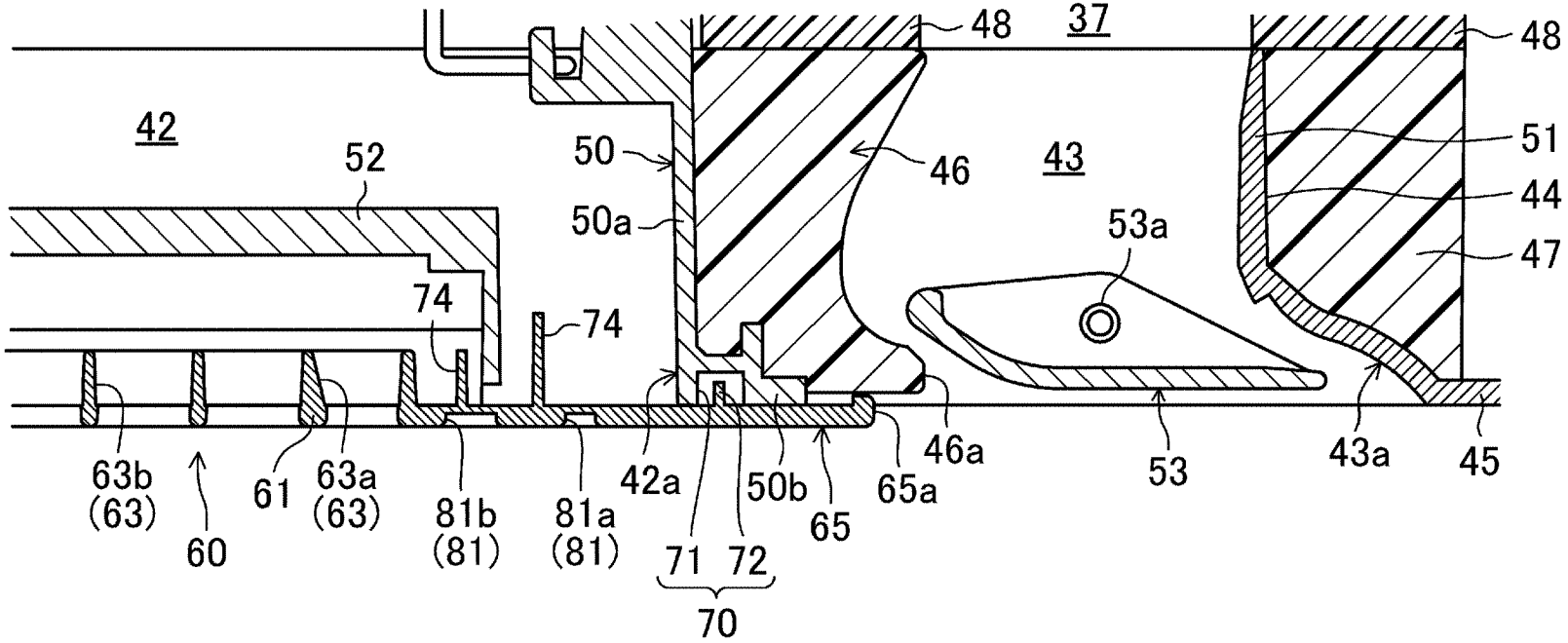
FIG. 9 is a partially enlarged view of FIG. 3.

As illustrated in FIGS. 3, 6, and 9, the extension (65) is configured as a plate body having a rectangular frame shape when viewed in plan, and extends outward from the entire periphery of the lower end of the grill body (61) to overlap with the lower surface of the panel body (41). In this embodiment, the extension (65) is provided to overlap with the respective lower surfaces of the inner heat insulating members (46) which form parts of the panel body (41). The extension (65) is also configured such that an end (65*a*) of the extension (65) extending toward the outlet ports (43*a*) is located closer to the suction port (42*a*) than the edges of the panel body (41) facing the outlet ports (43*a*), i.e., the respective outer edges (46*a*) of the inner heat insulating members (46). The end (65*a*) of the extension (65) is made thicker (i.e., to have a greater height in the vertical direction) than the rest thereof so as to be in contact with the respective lower surfaces of the inner heat insulating members (46). A kind of fiber to serve as a water-absorbing material which absorbs water is blown against, and fixed on, the respective lower surfaces of the inner heat insulating members (46). Thus, the end (65*a*) of the extension (65) is in contact with the respective lower surfaces of the inner heat insulating members (46) on which the water-absorbing material has been fixed.

The lower surface of the extension (65) has a large number of recesses (81) to improve the design of the suction grill (60). The recesses (81) will be described in detail later. On the other hand, on the upper surface of the extension (65), formed are a protruding wall (72) functioning as a regulating portion (70) which regulates the flow of air from the four outlet ports (43*a*) toward the suction port (42*a*), and two reinforcing ribs (74, 74). The two reinforcing ribs (74, 74) are formed to protrude upward from the upper surface of the extension (65) so as to surround, and extend along, the grill body (61). The two reinforcing ribs (74, 74) are located over a portion of the extension (65) with the multitude of recesses (81).

<Regulating Portion>

As illustrated in FIG. 9, a regulating portion (70) which regulates the flow of the air from the four outlet ports (43*a*) toward the suction port (42*a*) is provided between the upper surface of the extension (65) and the lower surface of the panel body (41). The regulating portion (70) is comprised of four grooves (71), each of which is cut in the lower surface of the panel body (41) to extend along an associated one of the four outlet ports (43*a*), and protruding walls (72), each of which protrudes from the upper surface of the extension (65) into an associated one of the four grooves (71) to extend in the longitudinal direction of the groove (71).

As illustrated in FIGS. 5 and 9, each of the four grooves (71) is cut in the lower surface of an associated one of the four side portions of the rectangular frame-shaped inner panel member (50) of the panel body (41) to be parallel to an associated one of the four outlet ports (43*a*). Specifically, the rectangular frame-shaped inner panel member (50) includes a tubular partition wall (50*a*) extending vertically and having a generally square transverse section, and a generally rectangular frame-shaped extending portion (50*b*) extending outward from the entire periphery of the lower end of the partition wall (50*a*). The four grooves (71) are respectively provided for the four side portions of the extending portion (50*b*). Each of the four grooves (71) has a slightly larger longitudinal dimension than its associated outlet port (43*a*). On the other hand, in the lower surface of the extending portion (50*b*) of the rectangular frame-shaped inner panel member (50), four deep grooves (73) which are deeper than the grooves (71) are cut to allow adjacent grooves (71) to communicate with each other. The four deep grooves (73) make the four grooves (71) communicate with each other. That is to say, in the lower surface of the rectangular frame-shaped inner panel member (50), the four grooves (71) and the four deep grooves (73) constitute a single rectangular groove.

Each of the protruding walls (72) has a rectangular frame shape, and stands upward on the upper surface of the extension (65) toward the inside of an associated one of the four grooves (71). Each of the protruding walls (72) is configured to have a height that allows the protruding wall to be housed in the rectangular groove formed in the lower surface of the inner panel member (50) by the four grooves (71) and the four deep grooves (73). The protruding walls (72) are formed integrally with the suction grill (60).

<Recesses>

As illustrated in FIG. 6, a large number of recesses (81) are formed in the lower surface of the decorative panel (40) to improve the design of the suction grill (60). In this embodiment, the large number of recesses (81) are formed in the lower surface of the extension (65) of the suction grill (60).

The large number of recesses (81) are arranged along, and to surround, the grill body (61). In this embodiment, each of those recesses (81) has a square cross section (transverse section). Those recesses (81) are arranged around the grill body (61) at the same pitch P (i.e., the interval between the respective centers of adjacent recesses (81)) as the pitch P at which the large number of suction ports (63) of the grill body (61) are arranged (i.e., the interval between the respective centers of adjacent suction ports (63)). In this embodiment, two lines of recesses (81) are formed so as to be arranged along, and to surround, the grill body (61).

The recesses (81*b*) forming the inner one of the two lines arranged along the grill body (61) have an opening width W3 of 6 mm and the recesses (81*a*) forming the outer one of the two lines have an opening width W4 of 3.5 mm. As described above, the grill body (61) is configured such that the outermost suction holes (63*a*) have a width W1 of 8.5 mm and the other suction holes (63*b*) arranged inside them have a width W2 of 11 mm. That is, the recesses (81) are configured to have an opening area smaller than a transverse cross-sectional area of the suction holes (63) cut through the grill body (61). Further, since the recesses (81) are configured such that the opening width W3 of the recesses (81*b*) forming the inner line is broader than the opening width W4 of the recesses (81*a*) forming the outer line, the recesses (81*a*) forming the outer line have a smaller opening area than the recesses (81*b*) forming the inner line.

In this configuration, a large number of openings including the suction holes (63) and the recesses (81) are formed in the lower surface of the decorative panel (40). Those openings are configured to have their opening area decreased gradually outward from the grill body (61) in the center portion of the decorative panel (40).

<Flow of Air in the Indoor Unit>

When the indoor fan (27) is operated, the indoor air is sucked from the indoor space (R) into the impeller housing space (29*b*) of the indoor fan (27) through the multitude of suction holes (63) of the suction grill (60), the panel-side suction channel (42) of the panel body (41), and the inner space (31*a*) of the bell mouth (31). The air in the impeller housing space (29*b*) is transported by the impeller (30) of the indoor fan (27), and is blown radially outward through the gap between the hub (28) and the shroud (29). The air blown out from the indoor fan (27) exchanges heat with a refrigerant flowing through the indoor heat exchanger (32) when it passes through the indoor heat exchanger (32). Thus, the air passing through the indoor heat exchanger (32) is cooled when the indoor heat exchanger (32) functions as an evaporator (i.e., during a cooling operation), and is heated when the indoor heat exchanger (32) functions as a condenser (i.e., during a heating operation). Then, the air that has passed through the indoor heat exchanger (32) is distributed into the four body-side blowout flow channels (37) of the indoor unit body (21), flow downward through the four panel-side blowout flow channels (43) of the decorative panel (40), and blow into the indoor space (R) through the four outlet ports (43*a*).

The indoor fan (27) is configured as a centrifugal blower driven by an indoor fan motor (27*a*). Thus, when the indoor fan (27) is driven, the quantity of an indoor airflow that passes through the outer peripheral portion of the grill body (61) of the suction grill (60) is smaller than that of an airflow passing through the inner portion of the grill body (61). Therefore, even if the grill body (61) is configured such that the width W1 of the outer suction holes (63*a*) is smaller than the width W2 of the inner suction holes (63*b*) arranged inside them as described above, the resistance to the air passing through the suction holes does not increase so much.

Further, in this embodiment, the outlet-side end (65*a*) of the extension (65) of the suction grill (60) is located closer to the suction port (42*a*) than the edge of the lower surface of the panel body (41) facing the outlet port (43*a*) (i.e., the outer edge (46*a*) of the inner heat insulating member (46)).

Thus, the air blown out through the outlet port (43*a*) is not blown against the outlet-side end (65*a*) of the extension (65), but is blown into the indoor space (R).

Moreover, in this embodiment, the suction grill (60) is not fitted in the suction port (42*a*), but is provided with the extension (65) which overlaps with the lower surface of the panel body (41) to cover the lower end of the suction port (42*a*). Thus, part of the air blown out through the outlet port (43*a*) may pass through the gap between the lower surface of the panel body (41) and the extension (65) of the suction grill (60) to flow into the suction port (42*a*) without being supplied into the indoor space (R). However, in this embodiment, the regulating portion (70) comprised of the grooves (71) and the protruding walls (72) is provided between the upper surface of the extension (65) of the suction grill (60) and the lower surface of the panel body (41). Thus, even if part of the air blown out through the outlet port (43*a*) flowed into the gap between the upper surface of the extension (65) of the suction grill (60) and the lower surface of the panel body (41), the air would collide against the protruding wall (72) standing in the groove (71) and would stagnate there. In this manner, the flow of the air from the outlet port (43*a*) toward the suction port (42*a*) is regulated.

<Design of Decorative Panel>

If the indoor unit includes a suction grill having rectangular suction holes as described above, a human who stays at a position where he/she can see the indoor unit easily may see the space behind the rectangular suction holes through these suction holes. Thus, only the suction port of the decorative panel will look dark, which impairs the beauty of the indoor space. On the other hand, for example, the lower surface of the decorative panel may be colored such that the color of a portion surrounding the dark suction port is gradually lightened outward from the center portion so as to obscure the boundary between the dark suction port and its surrounding portion. This may improve the design of the decorative panel. However, such a technique requires an additional coloring step, which increases the number of manufacturing process steps disadvantageously.

Thus, in this embodiment, as illustrated in FIGS. 2 and 6, a large number of recesses (81) are formed in the lower surface of the decorative panel (40) so as to be arranged along, and to surround, the grill body (61) having the suction holes (63). Thus, even if the grill body (61) looks dark due to the presence of the suction holes (63) to the eyes of a human who stays at a position where he/she can see the indoor unit (20) easily by moving his/her head slightly upward, a shadow cast by the recesses (81) arranged along the suction holes obscures the boundary between the dark portion of the grill body (61) and a portion surrounding the grill body (61) having no suction holes (63) and thus looking lighter. As a result, the suction grill (60) no longer impairs the beauty of the indoor space (R), and the design of the decorative panel improves as compared with a situation where the recesses (81) are not formed.

The large number of recesses (81) are arranged such that two or more lines of the recesses (81) are formed so as to be arranged along, and to surround, the grill body (61), and their opening area decreases gradually from the innermost one of the lines toward the outermost one. The recesses (81) with the smaller opening area cast a fainter shadow than the recesses (81) with the larger opening area. Thus, to the eyes of a human who stays at a position where he/she can see the indoor unit easily by moving his/her head slightly upward, the color of the lower surface of the decorative panel (40) appears to be gradually being lightened outward from the central grill body (61). This allows for further improving the design of the decorative panel (40).

Moreover, the lower surface of the decorative panel (40) has a large number of openings including the suction holes (63) and the recesses (81). Those openings have their opening area decreased gradually outward from the grill body (61) in the center portion of the decorative panel (40). Such a gradually changing opening area of the openings makes each of the openings inconspicuous. This allows for further improving the design of the decorative panel (40).

Further, in this embodiment, based on the fact that a stable field of fixation in which one can gaze an object easily by moving his/her head is in the range of 20 to 30 degrees upward from the horizontal direction, the grill body (61) of the suction grill (60) is configured such that the surrounding wall forming the suction holes (63) has the height H which is not less than the product of the width of the suction holes (63) and tan 30°. Thus, as illustrated in FIG. 8, the surrounding wall forming the suction holes (63) hides the space behind the suction holes (63) (the panel-side suction channel (42)) from the eyes of a human who stays at a position where he/she can see the indoor unit (20) easily by moving his/her head slightly upward, i.e., the suction holes (63) no longer look dark to him or her. As a result, the suction grill (60) no longer impairs the beauty of the indoor space (R), and the design of the decorative panel improves as compared with a situation where a conventional suction grill having rectangular suction holes is used.

Further, according to this embodiment, the outer suction holes (63*a*) arranged in the outer peripheral portion of the grill body (61) have a narrower width W1 than the width W2 of the other inner suction holes (63*b*) arranged inside them. That is, the surrounding wall forming the outer suction holes (63*a*) of the grill body (61) is thicker than the one forming the inner suction holes (63*b*). Thus, the outer peripheral portion of the lower surface of the grill body (61) has a lower opening area ratio per unit area than the inner portion. Consequently, to the eyes of a human who stays at a position where he/she can see the indoor unit (20) easily by moving his/her head slightly upward, the outer peripheral portion of the lower surface of the grill body (61) looks lighter in color than the inner portion, because the openings cast a fainter shadow there. On the other hand, comparing the lower surface of the grill body (61) with a portion surrounding the grill body (61), the latter portion looks slightly dark due to the shadow cast by the recesses (81) but still looks lighter in color than the lower surface of the grill body (61) having the large number of suction holes (63). In addition, comparing the portion having the large number of recesses (81) with its surrounding portion, the latter portion looks lighter in color than the portion with the recesses (81), because it has no suction holes (63) or recesses (81) and thus casts no shadows. Thus, in this configuration of this embodiment, to the eyes of a human who stays at a position where he/she can see the indoor unit (20) easily by moving his/her head slightly upward, the color of the lower surface of the decorative panel (40) appears to be gradually being lightened from the center portion toward the outer periphery. This allows for further improving the design of the decorative panel (40).

Moreover, in this embodiment, the suction grill (60) is comprised of the grill body (61) positioned over the suction port (42*a*) and the extension (65) extending outward from the entire periphery of the grill body (61) to overlap with the lower surface of the panel body (41), and the suction grill (60) is not fitted in the suction port (42*a*), but is arranged to cover the lower end of the suction port (42*a*). Therefore, unlike the configuration in which the suction grill (60) is fitted in the suction port (42*a*), no gap (or seam) is left between the portion of the panel body (41) surrounding the suction port (42*a*) (the inner panel member (50)) and the suction grill (60), which improves the design of the decorative panel (40).

—Advantages of Embodiments—

According to this embodiment, a large number of recesses (81) are formed in the lower surface of the decorative panel (40) so as to be arranged along, and to surround, the grill body (61) having a large number of suction holes (63). Thus, even if the grill body (61) looks dark to the eyes of a human who stays at a position where he/she can see the indoor unit (20) easily by moving his/her head slightly upward, a shadow cast by those recesses (81) arranged along the grill body (61) obscures the boundary between the dark grill body (61) and a portion surrounding the grill body (61) having no suction holes (63) and thus looking lighter. Therefore, in manufacturing the decorative panel (40), by merely providing the large number of suction holes (63) and the large number of recesses (81), the design of the decorative panel (40) is easily improved without increasing the number of manufacturing process steps by an additional coloring step, for example. Further, this embodiment also allows for providing an indoor unit (20) for an air conditioning device (1) including the decorative panel (40) which allows for improving the design of the suction grill (60) without increasing the number of manufacturing process steps.

Also, according to this embodiment, the large number of recesses (81) are formed such that two or more lines of the recesses (81) are formed so as to be arranged along, and to surround, the grill body (61), and that their opening area decreases gradually from the innermost one of the lines toward the outermost one. Thus, to the eyes of a human who stays at a position where he/she can see the indoor unit (20) easily by moving his/her head slightly upward, the color of the lower surface of the decorative panel (40) appears to be gradually being lightened outward from the central grill body (61). This simple configuration allows for further improving the design of the decorative panel (40).

Furthermore, according to this embodiment, the large number of recesses (81) are formed to have opening areas smaller than the transverse cross-sectional area of the suction holes (63) in the grill body (61). Thus, a large number of openings including the suction holes (63) and the recesses (81) formed in the lower surface of the decorative panel (40) are allowed to have their opening area decreased gradually outward from the central grill body (61). Such a gradually changing opening area of the openings makes each of the openings inconspicuous. This simple configuration allows for further improving the design of the decorative panel (40).

Besides, according to this embodiment, the decorative panel (40) is configured such that the grill body (61) of the suction grill (60) is formed in the shape of a grid to have a large number of suction holes (63) each having a square transverse section, and that the surrounding wall forming at least two of the suction holes (63) has a height H which is not less than the product of the width W of the suction holes (63) and tan 30°. Thus, as illustrated in FIG. 8, the grill body (61) is configured such that the height H of the surrounding wall is large enough relative to the width W of the suction holes (63) to hide the space behind the suction holes (63) from the eyes of a human who stays at a position where he/she can see the indoor unit (20) easily by moving his/her head slightly upward. As a result, the suction holes (63) no longer look dark to the eyes of the human who stays at such a position where he/she can see the indoor unit (20) easily by moving his/her head slightly upward. Thus, by determining the height H of the surrounding wall forming the suction holes (63) relative to the width W of the suction holes (63) such that the suction holes (63) do not look dark to the eyes of a human who stays at a position where he/she can see the indoor unit (20) easily by moving his/her head slightly upward, the design of the decorative panel (40) is easily improved without increasing the resistance to the air passing through the suction holes as in a situation where the width of the suction holes (63) is reduced.

In addition, according to this embodiment, the grill body (61) is configured such that among the suction holes (63) of the grill body (61), the inner ones (63*b*) having a broader width has a width W2 of 11 mm to 15 mm. Thus, even if the surrounding wall forming the suction holes (63) has its height H determined by multiplying the width W of the suction holes (63) by tan 30°, the indoor unit (20) is still prevented from increasing its overall size excessively. Further, according to this embodiment, the grill body (61) is configured such that the height H of the surrounding wall forming the suction holes (63) is not less than the product of the width W of the suction holes (63) and tan 30°, and is not more than the product of the width W and tan 40°. Thus, the height H of the surrounding wall forming the suction holes (63) is less than 15 mm even if it is obtained by multiplying the width W of the suction holes (63) by tan 40°. This allows for preventing the indoor unit (20) from increasing its overall size excessively.

Moreover, according to this embodiment, the grid-shaped grill body (61) is configured such that the outer suction holes (63*a*) arranged in the outer peripheral portion of the grill body (61) have a narrower width W1 than the width W2 of the inner suction holes (63*b*) arranged inside them. That is, the grill body (61) is configured such that the surrounding wall forming the outer suction holes (63*a*) of the grill body (61) is thicker than the one forming the inner suction holes (63*b*). Thus, to the eyes of a human who stays at a position where he/she can see the indoor unit (20) easily by moving his/her head slightly upward, the color of the lower surface of the decorative panel (40) appears to be gradually being lightened from the center portion toward the outer periphery. This simple configuration allows for further improving the design of the decorative panel (40).

Besides, according to this embodiment, the suction grill (60) is provided with an extension (65) extending outward from the entire periphery of the grill body (61), which is positioned over a suction port (42*a*), so as to overlap with the lower surface of the panel body (41). This allows for easy provision of a suction grill (60) with improved design without leaving any seams.

On top of that, according to this embodiment, the suction grill (60) including the grill body (61) having the large number of suction holes (63) and the extension (65) having the large number of recesses (81) is made of an injection-molded resin. Thus, those recesses (81) are easily provided while the suction grill (60) is being formed.

<<Other Embodiments>>

The above-described embodiments may be modified to have any of the configurations to be described below.

In the above-described embodiments, two lines of the recesses (81) are formed so as to be arranged along, and to surround, the grill body (61). However, this configuration of the recesses (81) is only a non-limiting example. Alternatively, a single line, or three or more lines of the recesses (81) may be formed to surround the grill body (61). Even when three or more lines of the recesses (81) are arranged to surround the grill body (61), the recesses (81) preferably also have their opening area decreased gradually from the innermost one of the lines toward the outermost one.

In the above-described embodiments, the suction grill (60) is comprised of the grill body (61) positioned over the suction port (42*a*) and the extension (65) extending outward from the entire periphery of the grill body (61) to overlap with the lower surface of the panel body (41), and the large number of recesses (81) are formed in the extension (65) of the suction grill (60). However, the suction grill (60) may consist of the grill body (61) alone. In such a case, the recesses (81) may be formed in a portion of the panel body (41) surrounding the grill body (61).

In the above-described embodiments, the grill body (61) is configured such that the surrounding wall forming the suction holes (63) has a height which is not less than the product of the width of the suction holes (63) and tan 30°. However, the surrounding wall forming the suction holes (63) may have a height less than the product of the width of the suction holes (63) and tan 30°. In such a case, even if the grill body (61) looks dark to the eyes of a human who stays at a position where he/she can see the indoor unit (20) easily, a shadow cast by the recesses (81) formed to surround the grill body (61) obscures the boundary between the dark grill body (61) and a portion surrounding the grill body (61) having no suction holes (63) and thus looking lighter. This allows for further improving the design of the decorative panel (40).

In the above-described embodiments, the four outlet ports (43*a*) are cut through the panel body (41) to surround the suction port (42*a*) provided in the center portion of the panel body (41). However, the number of the outlet ports (43*a*) is not limited thereto. Two, three, or more than four outlet ports may be provided around the suction port (42*a*). Alternatively, a single suction port (42*a*) and a single outlet port (43*a*) may even be cut through the panel body (41).

In the above-described embodiments, the indoor unit (20) of the air conditioning device (1) is configured as a ceiling mounted indoor unit fitted in the opening (O) of the ceiling (U). However, the indoor unit (20) may be configured as a ceiling suspended indoor unit that is suspended from the ceiling so as to be arranged in the indoor space (R). Further, the ceiling suspended indoor unit (20) may include a box-shaped casing including a top panel, four side panels, and a bottom panel, and the bottom panel may be configured as the decorative panel (40) of the present invention. In that case, the top panel and the four side panels are provided for the indoor unit body (21). That is, the decorative panel (40) is provided at the bottom of the indoor unit body (21).

The embodiments described above are merely illustrative ones in nature, and do not intend to limit the scope of the present invention or applications or uses thereof.

INDUSTRIAL APPLICABILITY

As can be seen from the foregoing description, the present invention is useful for a decorative panel and an indoor unit for an air conditioning device including the decorative panel.

DESCRIPTION OF REFERENCE CHARACTERS

1 Air Conditioning Device
20 Indoor Unit
21 Indoor Unit Body
40 Decorative Panel
41 Panel Body
42*a* Suction Port
43*a* Outlet Port
60 Suction Grill
61 Grill Body
63 Suction Hole
63*a* Suction Hole (Outer Suction Hole)
63*b* Suction Hole (Inner Suction Hole)
65 Extension
81 Recess

The invention claimed is:

1. A decorative panel for an air conditioning device, the decorative panel being attached to a bottom of an indoor unit body mounted on a ceiling, and comprising:

a panel body having a suction port; and a suction grill having a grill body which is formed in the shape of a grid having a plurality of suction holes and which is positioned over the suction port, the suction grill being attached to the suction port of the panel body, wherein a plurality of indentions are formed in a lower surface of the decorative panel so as to be arranged along, and to surround the grill body, and the plurality of indentions are formed such that two or more lines of the indentions are formed so as to be arranged along, and to surround, the grill body, and that their opening area decreases gradually from the innermost one of the lines toward the outermost one.

2. The decorative panel of claim 1, wherein the plurality of indentions are formed to have an opening area smaller than a transverse cross-sectional area of the plurality of suction holes.

3. The decorative panel of claim 2, wherein the suction grill has an extension extending outward from an entire periphery of the grill body to overlap with a lower surface of the panel body, and the indentions are formed in the extension.

4. The decorative panel of claim 2, wherein the grill body is configured such that each of the suction holes has a square transverse section, and that a surrounding wall forming at least two of the suction holes has a height which is not less than a product of a width of the suction holes and tan 30°, the suction grill has an extension extending outward from an entire periphery of the grill body to overlap with a lower surface of the panel body, and the indentions are formed in the extension.

5. The decorative panel of claim 2, wherein the grill body is configured such that each of the suction holes has a square transverse section, and that a surrounding wall forming at least two of the suction holes has a height which is not less than a product of a width of the suction holes and tan 30°, the grill body is configured such that outer ones of the suction holes arranged in an outer peripheral portion of the grill body have a narrower width than the other inner suction holes arranged inside the outer suction holes, the suction pill has an extension extending outward from an entire periphery of the grill body to overlap with a lower surface of the panel body, and the indentions are formed in the extension.

6. The decorative panel of claim 2, wherein the grill body is configured such that each of the suction holes has a square transverse section, and that a surrounding wall forming at least two of the suction holes has a height which is not less than a product of a width of the suction holes and tan 30°, the grill body is configured such that outer ones of the suction holes arranged in an outer peripheral portion of the grill body have a narrower width than the other inner suction holes arranged inside the outer suction holes, the grill body is configured such that the inner suction holes have a width of 11 mm to 15mm, the suction grill has an extension extending outward from an entire periphery of the grill body to overlap with a lower surface of the panel body, and the indentions are formed in the extension.

7. The decorative panel of claim 1, wherein the grill body is configured such that each of the suction holes has a square transverse section, and that a surrounding wall forming at least two of the suction holes has a height which is not less than a product of a width of the suction holes and tan 30°.

8. The decorative panel of claim 7, wherein the grill body is configured such that outer ones of the suction holes arranged in an outer peripheral portion of the grill body have a narrower width than the other inner suction holes arranged inside the outer suction holes.

9. The decorative panel of claim 8, wherein the grill body is configured such that the inner suction holes have a width of 11 mm to 15 mm.

10. The decorative panel of claim 1, wherein the suction grill has an extension extending outward from an entire periphery of the grill body to overlap with a lower surface of the panel body, and the indentions are formed in the extension.

11. The decorative panel of claim 10, wherein the suction grill is made of an injection-molded resin.

12. The decorative panel of claim 1, wherein the grill body is configured such that each of the suction holes has a square transverse section, and that a surrounding wall forming at least two of the suction holes has a height which is not less than a product of a width of the suction holes and tan 30°, the suction grill has an extension extending outward from an entire periphery of the grill body to overlap with a lower surface of the panel body, and the indentions are formed in the extension.

13. The decorative panel of claim 1, wherein the grill body is configured such that each of the suction holes has a square transverse section, and that a surrounding wall forming at least two of the suction holes has a height which is not less than a product of a width of the suction holes and tan 30°, the grill body is configured such that outer ones of the suction holes arranged in an outer peripheral portion of the grill body have a narrower width than the other inner suction holes arranged inside the outer suction holes, the suction grill has an extension extending outward from an entire periphery of the grill body to overlap with a lower surface of the panel body, and the indentions are formed in the extension.

14. The decorative panel of claim 1, wherein the grill body is configured such that each of the suction holes has a square transverse section, and that a surrounding wall forming at least two of the suction holes has a height which is not less than a product of a width of the suction holes and tan 30°, the grill body is configured such that outer ones of the suction holes arranged in an outer peripheral portion of the grill body have a narrower width than the other inner suction holes arranged inside the outer suction holes, the grill body is configured such that the inner suction holes have a width of 11 mm to 15mm, the suction grill has an extension extending outward from an entire periphery of the grill body to overlap with a lower surface of the panel body, and the indentions are formed in the extension.

15. An indoor unit for an air conditioning device, the indoor unit comprising:

an indoor unit body mounted on a ceiling; and a decorative panel attached to a bottom of the indoor unit body, wherein the decorative panel is configured as the decorative panel of claim 1.

* * * * *